US007150411B2

(12) United States Patent
Sheedy

(10) Patent No.: US 7,150,411 B2
(45) **Date of Patent: *Dec. 19, 2006**

(54) DRINKING STRAW

(76) Inventor: Paul Daniel Sheedy, 65 Kilmore Road, Artane Dublin 5 (IE)

( * ) Notice: Subject to any disclaimer, the term of this patent is extended or adjusted under 35 U.S.C. 154(b) by 0 days.

This patent is subject to a terminal disclaimer.

(21) Appl. No.: 11/169,992

(22) Filed: Jun. 28, 2005

(65) Prior Publication Data

US 2005/0247801 A1 Nov. 10, 2005

Related U.S. Application Data

(63) Continuation of application No. 10/610,333, filed on Jun. 30, 2003, now Pat. No. 6,948,664, which is a continuation of application No. 10/148,660, filed on May 31, 2002, now abandoned.

(30) Foreign Application Priority Data

Dec. 14, 1999 (GB) ..... 9929491.0

(51) Int. Cl.

| | |
|---|---|
| ***A47G 21/18*** | (2006.01) |
| ***A61J 15/00*** | (2006.01) |
| ***A63H 13/00*** | (2006.01) |

(52) U.S. Cl. ..... 239/33; 239/24; 446/200; 446/201

(58) Field of Classification Search ..... 239/33, 239/24; 446/200, 201, 202, 217, 218, 71; 73/1.16

See application file for complete search history.

(56) References Cited

U.S. PATENT DOCUMENTS

| | | | | |
|---|---|---|---|---|
| 3,315,405 | A * | 4/1967 | Hoffer | 446/71 |
| 3,332,622 | A * | 7/1967 | Lombard | 239/33 |
| 3,782,028 | A * | 1/1974 | Kelly | 446/200 |
| 4,252,273 | A * | 2/1981 | Karterman | 239/33 |
| 4,579,281 | A * | 4/1986 | Karterman | 239/33 |
| D294,671 | S | 3/1988 | Koziol | |

* cited by examiner

*Primary Examiner*—Kevin Shaver
*Assistant Examiner*—Darren Gorman
(74) *Attorney, Agent, or Firm*—Anthony R. Barkume, P.C.

(57) ABSTRACT

A drinking straw (1) has a spherical transparent housing (2) formed part way up it in which there is a ball (3) which can be marked or decorated and when a drink is sucked up the straw (1) the ball (3) rotates.

16 Claims, 2 Drawing Sheets

DRINKING STRAW

CROSS-REFERENCE TO RELATED APPLICATIONS

This application is a continuation application of U.S. co-pending application Ser. No. 10/610,333, filed on Jun. 30, 2003, now U.S. Pat. No. 6,948,664, which is a continuation application of U.S. application Ser. No. 10/148,660, filed or May 31, 2002, now abandoned The present invention relates to straw or the like in which there is a device which rotates when liquid is sucked up the straw.

Straws are used for drinking from glasses, containers etc. and, in order to make them more attractive to look at and more fun to use, they can be bent into shapes, loops and coloured etc. The use of such straws can encourage users, particularly if they are children, to drink more.

I have now devised an improved drinking straw.

According to the invention there is provided a drinking straw in which there is a housing, spaced apart from the ends of the drinking straw, with the interior of the housing forming part of the straw and in which housing there is a rotatable device so that, when fluid passes through the straw, the device is rotated by the passage of the fluid.

By the term drinking straw is meant any tubular conduit which can be used for drinking and can be made of any conventionally used material such as waxed paper, a plastics material such as polyethylene, polypropylene, polyvinylchloride a polyterephthalate etc. and the straw can be straight curved or any other shape.

The housing is preferably substantially spherical, with the straw offset from the centre of the housing. The housing is preferably substantially transparent so that the rotation of the device can be seen and the device can have a logo, trademark, pattern or design etc. on it which can be seen as it rotates.

Although a substantially spherical shape is preferred for the housing the housing can deviate from the spherical e.g. it can be a flattened sphere or have an ellipsoidal cross section or can be substantially cylindrical with the device inside the housing corresponding in shape to the housing so that it can rotate freely within the housing.

The device preferably fits within the housing with only a small gap between the device and the housing.

In a preferred embodiment of the invention the device is substantially spherical i.e. it is ball shaped, and fits within a substantially spherical housing.

Preferably there is channel formed round the outside of the device in which there are vanes, so that the passage of a fluid impinges on the vanes and makes it easier to rotate the ball.

Although the straw is primarily for use with drinking liquids it can function by blowing or sucking air through it and can be used as a toy or amusement in its own right.

The invention is illustrated in the accompanying drawings in which.

Figure 1:
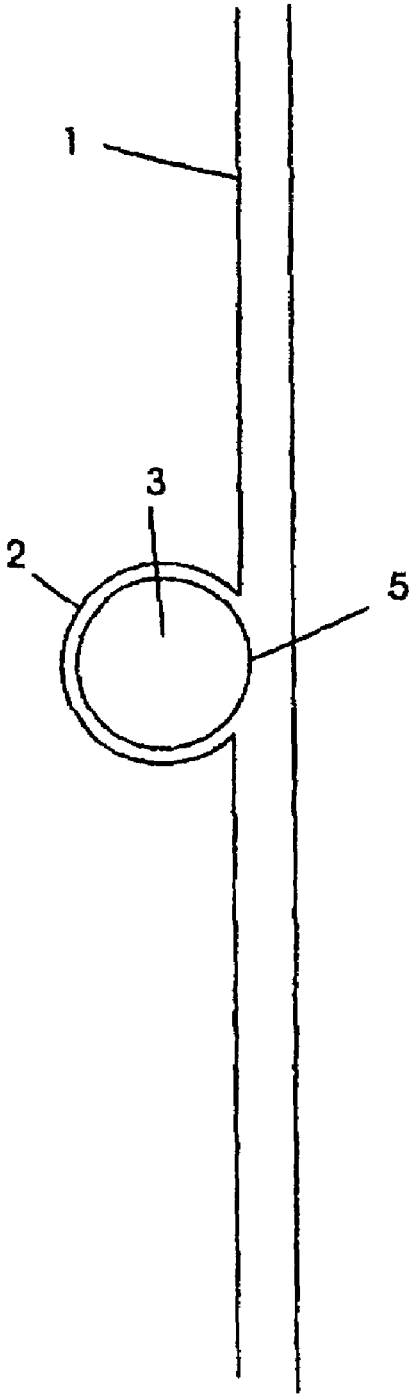
FIG. 1 is a side view of the drinking straw

Referring to FIG. 1 a drinking straw (1) has a transparent spherical housing (2) formed in it so fluid passing through the straw passes through the housing (2). Within the housing (2) there is spherical ball (3) which is free to rotate within the housing.

Figure 2:
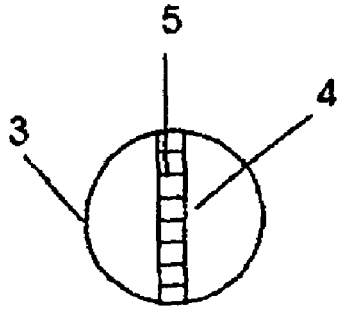
FIG. 2 is a plan view of the rotor in accordance with the spherical and substantially spherical embodiments of the invention.

Referring to FIG. 2 the ball (3) has a channel (4) formed around a circumference in which there are vanes (5). The ball is positioned in the housing so that fluid passing through the straw will impinge on the vanes.

In use fluid e.g. a drink is sucked up the straw and impinges on the vanes (5) of the ball (3) and causes the ball to rotate and the ball and its rotation is visible from outside the housing.

Figure 3:
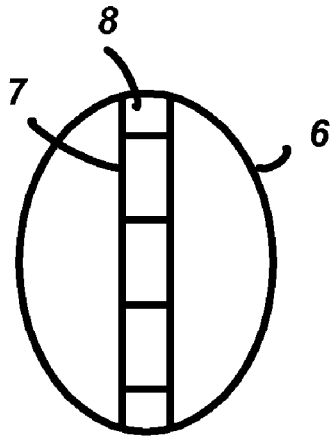
FIG. 3 is a plan view of the rotor in accordance with the ellipsoidal cross-section embodiment of the invention.

Referring to FIG. 3, the ball (6) has an ellipsoidal shape, and has a channel (7) formed around a circumference in which there are vanes (8). In a manner similar to the main embodiment shown in FIGS. 1 and 2, the ball is positioned in the housing so that fluid passing through the straw will impinge on the vanes.

Figure 4:
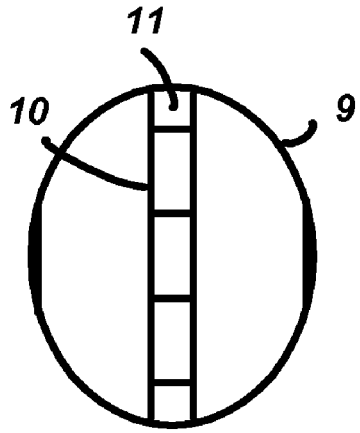
FIG. 4 is a plan view of the rotor in accordance with the flattened sphere embodiment of the invention.

Referring to FIG. 4, the ball (9) has a flattened sphere shape, and has a channel (10) formed around a circumference in which there are vanes (11). In a manner similar to the main embodiment shown in FIGS. 1 and 2, the ball is positioned in the housing so that fluid passing through the straw will impinge on the vanes.

Figure 5:
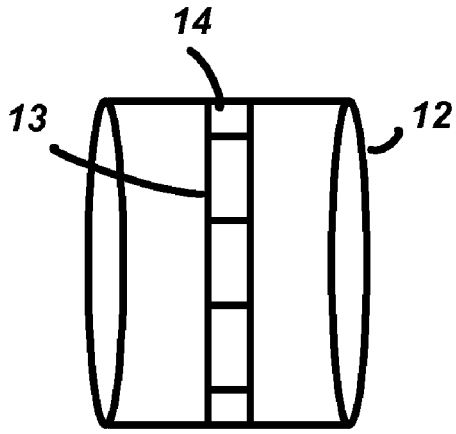
FIG. 5 is a slightly off-center plan view of the rotor in accordance with the substantially cylindrical embodiment of the invention.

Referring to FIG. 5, the ball (12) has a substantially cylindrical shape, and has a channel (13) formed around a circumference in which there are vanes (14). In a manner similar to the main embodiment shown in FIGS. 1 and 2, the ball is positioned in the housing so that fluid passing through the straw will impinge on the vanes.

In use a range of visual effects can be achieved by colouring or patterning the ball or having a logo or words etc. on the ball.

The invention claimed is:

1. A drinking straw having first and second ends and further comprising:

a housing of substantially transparent material located in and spaced apart from the ends of the straw with the interior of the housing forming part of the straw; and a single substantially spherical rotor within the housing, said substantially spherical rotor having a substantially spherical surface and comprising:

a channel extending around a circumference of said substantially spherical rotor and embedded within the surface of the substantially spherical rotor, and a plurality of vanes disposed within said channel and arranged such that fluid passing through the straw will impinge on the vanes and cause the rotor to rotate with respect to the housing.

2. The straw of claim 1, wherein said first end of said straw and said second end of said straw are substantially axially aligned along a first axis and said rotor is arranged to rotate about an axis which is substantially perpendicular to said first axis.

3. The straw of claim 1, wherein said housing has a center and said straw is offset from said center of said housing.

4. The straw of claim 1, wherein the rotor fits within the housing with only a small gap between said rotor and said housing and corresponds in shape to the housing so that it can rotate freely in said housing.

5. A drinking straw having first and second ends and further comprising:

a housing of substantially transparent material located in and spaced apart from the ends of the straw with the interior of the housing forming part of the straw; and a single rotor within the housing, said rotor having the shape of a flattened sphere and comprising:

a channel extending around a circumference of said rotor and embedded within a surface of the rotor, and a plurality of vanes disposed within said channel and arranged such that fluid passing through the straw will impinge on the vanes and cause the rotor to rotate with respect to the housing.

6. The straw of claim 5, wherein said first end of said straw and said second end of said straw are substantially axially aligned along a first axis and said rotor is arranged to rotate about an axis which is substantially perpendicular to said first axis.

7. The straw of claim 5, wherein said housing has a center and said straw is offset from said center of said housing.

8. The straw of claim 5, wherein the rotor fits within the housing with only a small gap between said rotor and said housing and corresponds in shape to the housing so that it can rotate freely in said housing.

9. A drinking straw having first and second ends and further comprising:

a housing of substantially transparent material located in and spaced apart from the ends of the straw with the interior of the housing forming part of the straw; and a single rotor within the housing, said rotor having an ellipsoidal cross-section and comprising:

a channel extending around a circumference of said rotor and embedded within a surface of the rotor, and a plurality of vanes disposed within said channel and arranged such that fluid passing through the straw will impinge on the vanes and cause the rotor to rotate with respect to the housing.

10. The straw of claim 9, wherein said first end of said straw and said second end of said straw are substantially axially aligned along a first axis and said rotor is arranged to rotate about an axis which is substantially perpendicular to said first axis.

11. The straw of claim 9, wherein said housing has a center and said straw is offset from said center of said housing.

12. The straw of claim 9, wherein the rotor fits within the housing with only a small gap between said rotor and said housing and corresponds in shape to the housing so that it can rotate freely in said housing.

13. A drinking straw having first and second ends and further comprising:

a housing of substantially transparent material located in and spaced apart from the ends of the straw with the interior of the housing forming part of the straw; and a single rotor within the housing, said rotor having a substantially cylindrical shape and comprising:

a channel extending around a circumference of said rotor and embedded within a surface of the rotor, and a plurality of vanes disposed within said channel and arranged such that fluid passing through the straw will impinge on the vanes and cause the rotor to rotate with respect to the housing.

14. The straw of claim 13, wherein said first end of said straw and said second end of said straw are substantially axially aligned along a first axis and said rotor is arranged to rotate about an axis which is substantially perpendicular to said first axis.

15. The straw of claim 13, wherein said housing has a center and said straw is offset from said center of said housing.

16. The straw of claim 13, wherein the rotor fits within the housing with only a small gap between said rotor and said housing and corresponds in shape to the housing so that it can rotate freely in said housing.

* * * * *